US008023687B2

(12) United States Patent
Matsuda et al.

(10) Patent No.: US 8,023,687 B2
(45) Date of Patent: Sep. 20, 2011

(54) LOUDSPEAKER

(75) Inventors: Kyoichi Matsuda, Yamagata (JP); Seiya Sato, Yamagata (JP)

(73) Assignees: Pioneer Corporation, Tokyo (JP); Tohoku Pioneer Corporation, Yamagata (JP)

( * ) Notice: Subject to any disclaimer, the term of this patent is extended or adjusted under 35 U.S.C. 154(b) by 1143 days.

(21) Appl. No.: 11/527,721

(22) Filed: Sep. 27, 2006

(65) Prior Publication Data

US 2007/0071275 A1 Mar. 29, 2007

(30) Foreign Application Priority Data

Sep. 27, 2005 (JP) ..... 2005-280003

(51) Int. Cl.
*H04R 25/00* (2006.01)

(52) U.S. Cl. ..... 381/398; 381/423; 381/432

(58) Field of Classification Search ..... 381/353, 381/386, 398, 423, 424, 426, 432; 181/171, 181/172; 29/594, 609.1
See application file for complete search history.

(56) References Cited

U.S. PATENT DOCUMENTS

| | | | | |
|---|---|---|---|---|
| 5,608,810 | A * | 3/1997 | Hall | 381/398 |
| 7,711,138 | B2 * | 5/2010 | Howze | 381/398 |

FOREIGN PATENT DOCUMENTS

| | | | |
|---|---|---|---|
| JP | 61-121689 | A | 6/1986 |
| JP | 63-12988 | | 1/1988 |
| JP | 5-161193 | A | 6/1993 |
| JP | 2001-25088 | A | 1/2001 |
| JP | 2004-64610 | A | 2/2004 |

* cited by examiner

*Primary Examiner* — Huyen D Le
(74) *Attorney, Agent, or Firm* — Arent Fox LLP

(57) ABSTRACT

A loudspeaker includes a diaphragm and an edge having an inner periphery end portion thereof connected with an outer periphery of the diaphragm, in which an outer end portion of the edge is attached to a speaker frame. The diaphragm has a bent portion in the vicinity of a border at the inner periphery side of a connecting portion connecting the diaphragm with the edge. A reinforcing portion is formed on the bent portion in order to reinforce the bent portion. It is, therefore, possible to disperse or reduce various forces applied to the bent portion, and to prevent strength deterioration or damage of the diaphragm even when sound signals having large amplitude are applied to the loudspeaker. As a result, it is also possible to prevent deterioration of acoustic characteristics.

13 Claims, 10 Drawing Sheets

LOUDSPEAKER

BACKGROUND OF THE INVENTION

1. Field of the Invention

The present invention relates to a loudspeaker.

The present application claims priority from Japanese Application No. 2005-280003, the disclosure of which is incorporated herein by reference.

2. Description of the Related Art

There has been known various types of loudspeakers such as a fixed-edge speaker or a free-edge speaker. In the fixed-edge speaker, a diaphragm and an edge are integrally formed by the same material. In the free-edge. speaker, a diaphragm and an edge are formed by a separate process, and then the edge is bonded onto an outer periphery of the diaphragm. Japanese Patent Application Laid-open No. 2001-25088 discloses the free-edge speaker, in which an up-rolled edge is arranged in an outer periphery of the loud speaker and a diaphragm is arranged on an inner periphery of the up-rolled edge to be connected thereto.

A free-edge speaker 100J has a basic structure as shown in FIG. 1B. In specific, a magnetic circuit 1 includes a magnet 2, a lower plate 3, and an upper plate 4. In the magnetic circuit 1, a gap between magnetic poles is formed between the upper plate 4 and a center pole 5 which stands straight from a center position of the lower plate 3. A coil bobbin 6 which sets a voice coil 7 by winding is located so as to arrange the voice coil 7 within the gap between the magnetic poles.

A center cap 8 is mounted in the proximity of an upper end Of the coil bobbin 6. In the vicinity of the upper end of the coil bobbin 6, a center portion of a diaphragm 9 is fixed. An edge 12 is connected with an outer periphery of the diaphragm 9. A bent portion 91 is formed on the inner periphery side of the connecting portion. The diaphragm 9 is attached on an upper portion of a speaker frame 10, which is provided on the upper plate 4, through the edge 12.

On the upper portion of the speaker frame 10 is formed an outer peripheral rim 10*a*, which has an attaching surface 10*b*inside it. Outside the edge 12 is formed an outer end portion 12*a*, which is mounted by a gasket 13 attached on the attaching surface 10*b* of the speaker frame 10. The outer end portion 12*a* is pressed down onto the attaching surface 10*b* by the gasket 13, which is also attached onto the attaching surface 10*b*, so as to be airtightly attached onto the attaching surface 10*b*. In addition, one end of a damper 11 is connected with the coil bobbin 6, and the other end thereof is supported by a damper supporting section 11*a*, which is connected with the speaker frame 10, so that the voice coil 7 can be accurately held within the gap between the magnetic poles of the magnetic circuit 1.

In such a configured loudspeaker, the coil bobbin 6 is oscillated according to driving signals supplied to the voice coil 7. The diaphragm 9, which is supported by the damper 11 and the edge 12 having a function of suspension, is oscillated by the oscillation of the coil bobbin 6, thereby reproducing sound based on sound signals supplied to the voice coil 7.

When sound signals having large amplitude are applied to the above-mentioned loudspeaker, however, the diaphragm 9 is driven at large amplitude to apply a heavy load to a bent portion 91 that is formed in a border of a connecting portion connecting the diaphragm 9 and the edge 12. As a result, there may occur strength deterioration of the diaphragm 9. If the diaphragm 9 has serious strength deterioration, the bent portion 91 may have a crack or the like so that the diaphragm 9 can be damaged.

When the sound signals having large amplitude are applied to the loudspeaker, there occurs the strength deterioration or damage of the diaphragm 9, which can deteriorate acoustic characteristics of the loudspeaker.

SUMMARY OF THE INVENTION

The present invention is to cope with the above-mentioned problems. An object of the present invention is to provide a loudspeaker including a diaphragm, an edge to be connected with an outer periphery of the diaphragm, and a bent portion formed in the vicinity of a border of a connecting portion connecting the diaphragm and the edge, wherein it is possible to prevent strength deterioration or damage of the diaphragm even when sound signals having large amplitude is inputted, and to prevent deterioration of acoustic characteristics.

In order to achieve the above objects, the present invention shall include at least components set forth in the following aspects.

According to one aspect of the present invention, a loudspeaker includes a diaphragm and an edge to be connected with the outer periphery of the diaphragm, wherein the outer end portion of the edge is attached onto a speaker frame. The diaphragm has a bent portion in the vicinity of a border at an inner periphery side of a connecting portion connecting the diaphragm with the edge. The bent portion is provided with a reinforcing portion for reinforcing the bent portion.

BRIEF DESCRIPTION OF THE DRAWINGS

These and other objects and advantages of the present invention will become clear from the following description with reference to the accompanying drawings, wherein:

FIG. 1A is a plan view of the loudspeaker 100J; and FIG. 1B is a sectional view taken along a line X-X shown in FIG. 1A;

FIG. 2A is a plan view of the loudspeaker 100; and FIG. 2B is a sectional view taken along a line A-A shown in FIG. 2A;

FIG. 9A is a plan view of the loudspeaker 100*f*, and FIG. 9B is a sectional view taken along a line A-A shown in FIG. 9A.

DETAILED DESCRIPTION OF THE PREFERRED EMBODIMENTS

A loudspeaker according to an embodiment of the present invention includes a diaphragm and an edge to be connected with an outer periphery of the diaphragm, wherein an outer end portion of the edge is attached on a speaker frame. The diaphragm has a bent portion in the vicinity of a border on the inner periphery side of a connecting portion connecting the diaphragm and the edge. The bent portion is provided with a reinforcing portion in order to reinforce the bent portion.

According to the loudspeaker configured as above, strength deterioration or damage of the diaphragm can be prevented even when sound signals having large amplitude are applied to the loudspeaker, because the bent portion is reinforced by the reinforcing portion so as to increase the strength of the bent portion. It is also possible to prevent deterioration of acoustic characteristics by such the reinforcing portion.

Hereinafter, a loudspeaker according to embodiments of the present invention will be described in detail with reference to the drawings.

First Embodiment

Figure 1A:
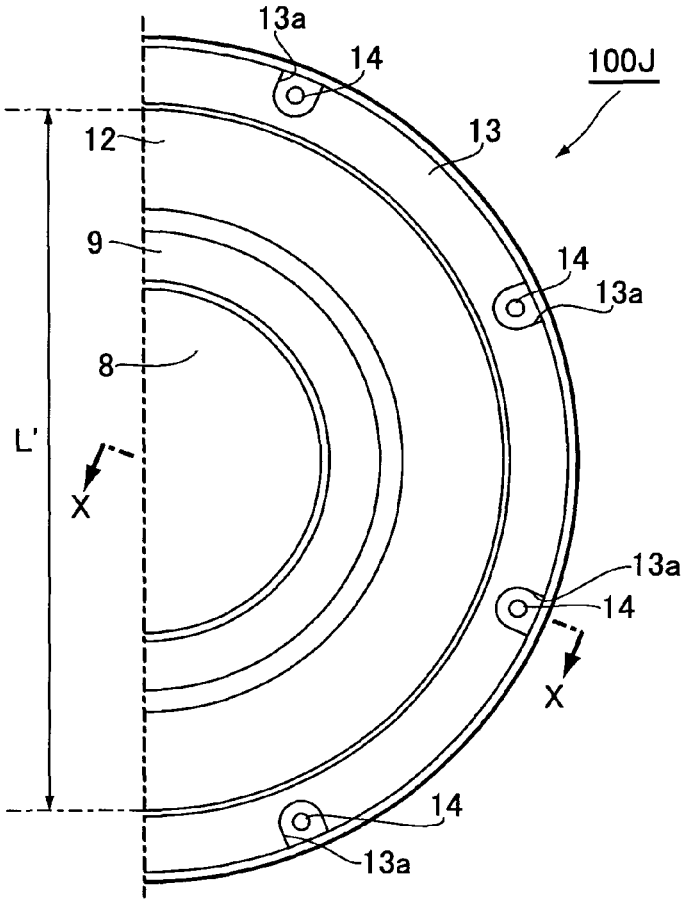
FIG.1 A PRIOR ART
FIGS. 1A and 1B illustrate a generally-used loudspeaker 100J.
Figure 1B:
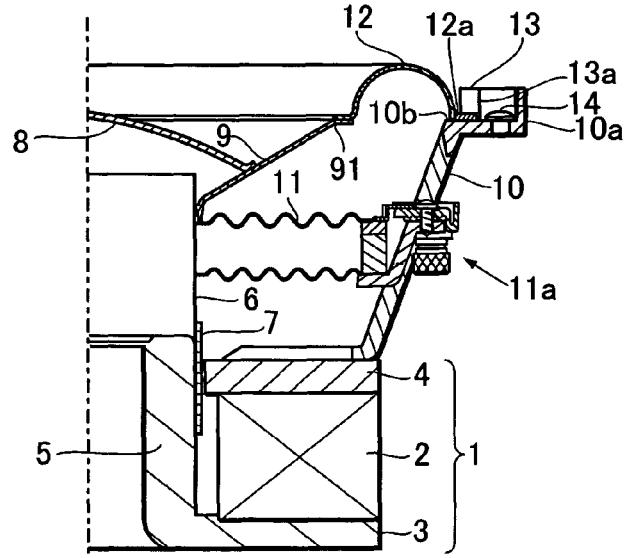
FIG.1 B PRIOR ART
Figure 2A:
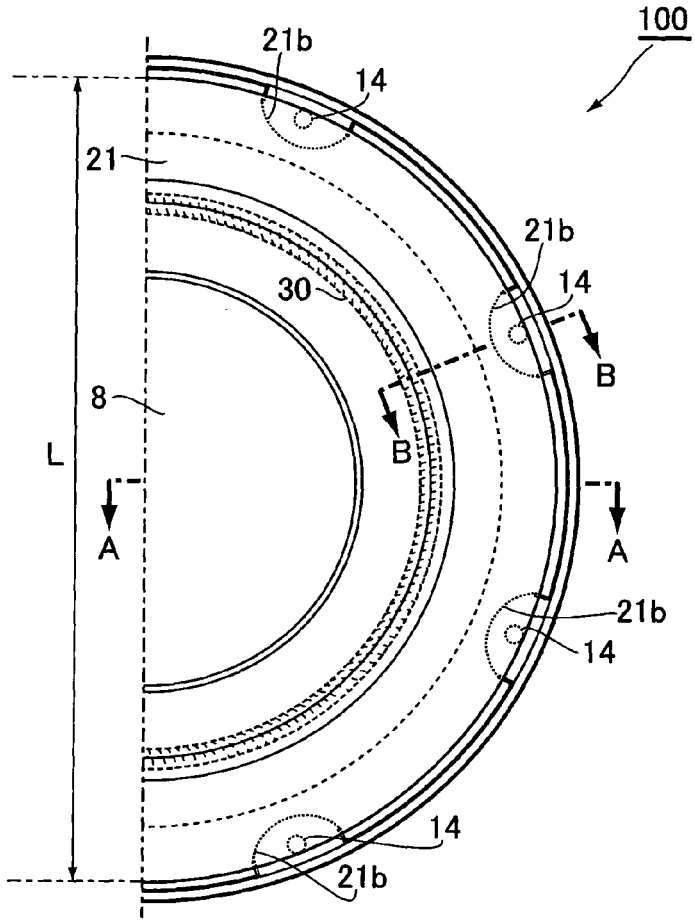
FIGS. 2A and 2B illustrate a configuration of a loudspeaker 100 according to the first embodiment of the present invention.
Figure 2B:
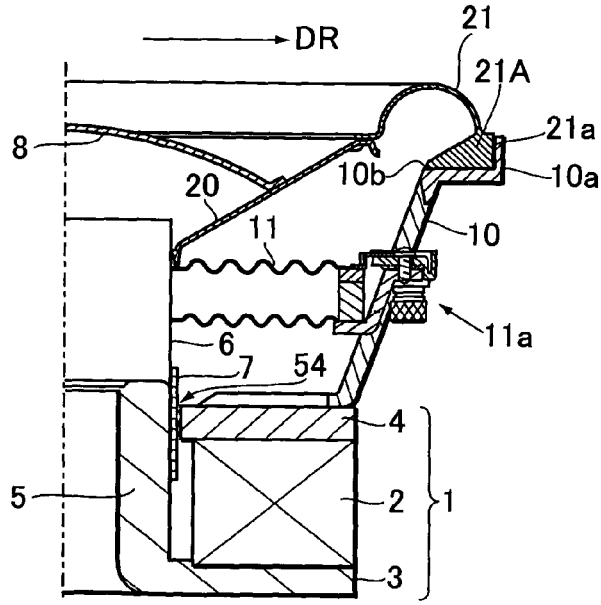
Figure 3:
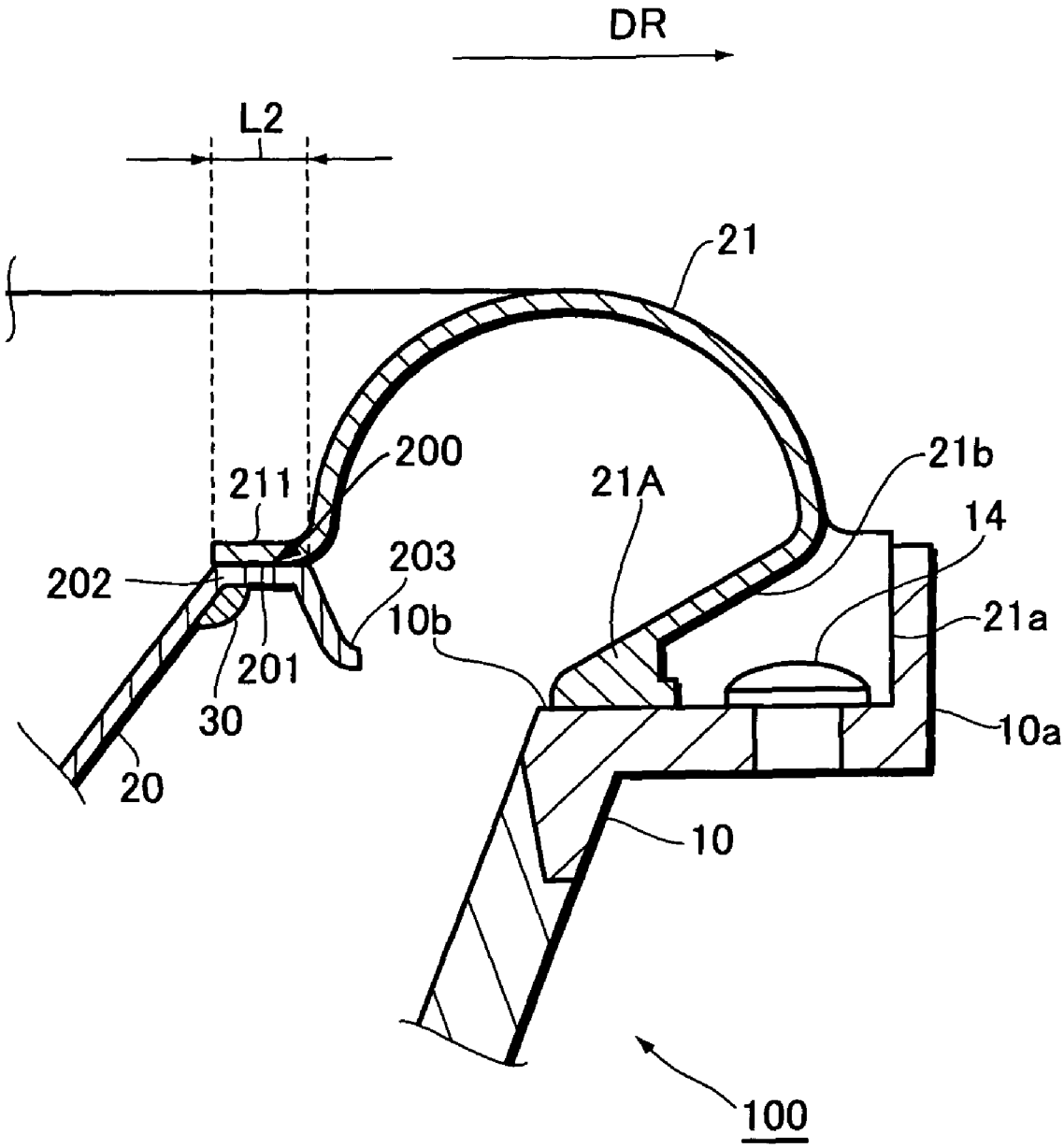
FIG. 3 is an enlarged view showing the vicinity of an edge of the diaphragm shown in FIG. 2B.

FIGS. 2A and 2B illustrate a configuration of a loudspeaker 100 according to the first embodiment of the present invention. FIG. 2A is a plan view of the loudspeaker 100, and FIG. 2B is a sectional view taken along a line A-A shown in FIG. 2A. FIG. 3 is an enlarged view showing the vicinity of an outer end portion of the diaphragm 20 shown in FIG.. 2B. The same parts as those in the conventional speaker are designated by the same reference numerals and their description is partially omitted.

The loudspeaker 100 of the present embodiment includes a magnetic circuit 1 having a magnet 2, a lower plate 3, and an upper plate 4, as shown in FIG. 2B. In the magnetic circuit 1, a gap 54 between magnetic poles is formed between the upper plate 4 and a center pole 5 which stands straight from a center position of the lower plate 3. A voice coil 7 is located within the gap 54. A center cap 8 is mounted in the vicinity of an upper end of the coil bobbin 6. A center portion of the diaphragm 20 is fixed in a vicinity thereof as shown in FIG. 2B.

As shown in FIGS. 2B and 3, the loudspeaker 100 includes the diaphragm 20 and an edge 21 to be connected with an outer periphery of the diaphragm 20. The outer end portion of the edge 21 is attached on an upper portion of a speaker frame 10, which is provided on the upper plate 4. In specific, the diaphragm 20 is connected with an inner periphery 211 of the edge 21 through a connecting portion 200 formed in the vicinity of the outer periphery thereof. In the connecting portion 200, the outer periphery of the diaphragm 20 and the inner periphery 211 of the edge 21 are attached with each other on the attaching surface 201 by an adhesive agent or the like. specifically, in the connecting portion 200, the outer periphery of the diaphragm 20 and the inner periphery 211 of the edge 21 are connected with each other by a predetermined width L2 along the radial direction DR of the diaphragm 20, as shown in FIG. 3.

The edge 21 has the functions of, for example, terminating acoustic sound by the diaphragm 20, holding the diaphragm 20 in a predetermined position by supporting the periphery of the diaphragm 20, holding the diaphragm 20 in such a way to move the diaphragm 20 flexibly and freely, and damping the horizontal vibration of the diaphragm 20.

As shown in FIG. 3, the diaphragm 20 of the present embodiment has a bent portion 202 in the vicinity of a border on the inner periphery side of the connecting portion 200 connecting the diaphragm 20 and the edge 21. In specific, the diaphragm 20 is provided with the bent portion 202 in the vicinity of the border on the inner periphery side of the attaching surface 201, where the outer periphery of the diaphragm 20 and the inner periphery 211 of the edge 21 are connected with each other.

As shown in FIG. 3, the bent portion 202 according to the present embodiment is bent in a direction opposite to the tilting direction of the inverted conical diaphragm 20. That is, the bent portion 202 is bent towards the backside of the diaphragm 20.

When sound signals having large amplitude are applied, for example, the diaphragm 20 can be driven by large amplitude to apply a heavy load to the bent portion 202. For this reason, in the loudspeaker 100 of the present embodiment, the bent portion 202 is provided with a reinforcing portion 30 in order to reinforce the bent portion 202, as shown in FIG. 3.

The reinforcing portion 30, for example, has higher elasticity or higher internal loss property than a predetermined value. The reinforcing portion 30 is preferably formed by a member having high elasticity and high internal loss property, such as silicon, a resin material, a rubber, and an unwoven fabric. The reinforcing portion 30 according to the embodiment is formed by coating a reinforcing agent having high elasticity and high internal loss property, such as silicon or the like, on the bent portion 202.

According to the loudspeaker 100 provided with the reinforcing portion 30 configured as above, it is possible to disperse or reduce various excessive forces applied to the bent portion 202 such as bending force, shearing force, extension, or internal stress, and to prevent strength deterioration or damage of the diaphragm 20, even when sound signals having large amplitude are applied to the loudspeaker 100 and thus a relatively high vibration of the diaphragm 20 is caused. Additionally, it is also possible to prevent deterioration of acoustic characteristics.

The reinforcing portion 30 is preferably formed on either or both of the inner side (back side) and the outer side (surface side) of the bent portion 202 in order to reinforce the bent portion 202. As shown in FIG. 3, the reinforcing portion 30 of the present embodiment is formed on the inner side of the bent portion 202. Preferably, the reinforcing portion 30 is formed on both of the inner side and outer side of the bent portion 202 in order to further increase the strength of the reinforcement.

The reinforcing portion 30 according to the present embodiment is formed all around the bent portion 202 along a circumferential direction of the diaphragm 20. Thereby, it is possible to further increase the strength of the bent portion 202 of the diaphragm 20.

The diaphragm 20 of this embodiment has a folding portion 203 that is formed on an outermost periphery of the connecting portion 200 of the diaphragm 20 to reinforce the bent portion 202. Specifically, the folding portion 203 is formed on the outer periphery of the connecting portion 200 of the diaphragm 20 in such a way that the folding portion 203 is bent towards the backside of the diaphragm 20, as shown in FIG. 3. That is, the folding portion 203 is bent in a direction opposite to the tilting direction of the inverted conical diaphragm 20. The folding portion 203 has functions to reinforce the strength of the outer periphery of the diaphragm 20, particularly, to improve the strength in the vicinity of the outer periphery of the diaphragm 20.

In addition, the folding portion 203 prevents the reinforcing agent from dripping down when a reinforcing agent coated on the reinforcing portion 30 has a relatively low-viscosity.

As shown in FIG. 3, an outer peripheral rim 10*a* is formed on the upper portion of the speaker frame 10. A mounting surface 10*b* is formed inside the outer peripheral rim 10*a*. At the outer end of the edge 21 is formed an outer end portion 21A for mounting the outer end of the edge 21 upon the mounting surface 10*b*, which is formed at the inside of the outer peripheral rim 10*a* of the speaker frame 10.

The outer end portion 21A is integrally formed with the edge 21 by pressure forming of, for example, urethane or rubber, and has a desired thickness, wherein it is formed with a direction to the inside from the outermost periphery of the edge 21. A bottom surface of the outer end portion 21A is bonded onto the mounting surface 10*b* of the speaker frame 10, and an outer peripheral surface 21*a* thereof abuts on the inside of the outer peripheral rim 10*a* of the speaker frame 10.

According to such a construction, the outer periphery of the edge 21 can be disposed adjacently to the outer peripheral rim 10*a* of the speaker frame 10, thereby enlarging an outer diameter L formed by the diaphragm 20 and the edge 21 until a maximum thereof.

In addition, the positioning of the edge 21 is performed by making the outer peripheral surface 21*a* of the outer end portion 21A abut against the outer peripheral rim 10*a* of the speaker frame 10, thereby omitting the gasket for the positioning, so that the number of parts can be reduced.

As shown in FIG. 3, a mounting screw section 14 is provided upon the mounting surface 10*b*, which is inside the outer peripheral rim 10*a* of the speaker frame 10. Then, in order to prevent the screw from exerting influence to an oscillation portion of the edge 21, the thickness of the outer end portion 21A is made to be thicker than that of the screw head of the mounting screw section 14, and also a notch 21*b* is formed so as to keep the mounting screw section 14 away from the outer end portion 21A.

Description will be given to operation of the loudspeaker 100 configured as above with reference to FIGS. 2B and 3.

In such the configured loudspeaker 100, the coil bobbin 6 is oscillated according to sound signals supplied to the voice coil 7 through a lead wire (not shown). The diaphragm 9, which is supported by the damper 11 and the edge 12 having a function of suspension, is oscillated by the oscillation of the coil bobbin 6, thereby reproducing sound based on sound signals supplied to the voice coil 7.

When sound signals having large amplitude, particularly the sound signals having high level, are inputted into the voice coil 7, the coil bobbin 6 is oscillated relatively largely to cause relatively large oscillation of the diaphragm 20 in accordance with the oscillation of the coil bobbin 6. At this time, the reinforcing portion 30 disperses or reduces various forces applied to the bent portion 202 because the bent portion 202 of the diaphragm 20 is provided with the reinforcing portion 30 that has high elasticity and high internal loss property. In addition, as the folding portion 203 is formed in the vicinity of the bent portion 202, the folding portion 203 further disperses or reduces various forces applied to the bent portion 202.

As described above, the loudspeaker 100 of this embodiment includes the diaphragm 20 and the edge 21 having the inner periphery end portion thereof connected with the outer periphery of the diaphragm 20, and the outer end portion thereof attached to the speaker frame 10. The diaphragm 20 has the bent portion 202 in the vicinity of a border on the inner periphery side of the connecting portion 200 connecting the diaphragm 20 and the edge 21. The reinforcing portion 30 is formed on the bent portion 202 in order to reinforce the bent portion 202. It is, therefore, possible to disperse or reduce various forces applied to the bent portion 202, and to prevent strength deterioration or damage of the diaphragm 20 even when sound signals having large amplitude are applied to the loudspeaker 100. As a result, it is also possible to prevent deterioration of acoustic characteristics.

Second Embodiment

FIG.. 4 is a view illustrating a loudspeaker 100*a* according to the second embodiment of the present invention, and is an enlarged view showing the vicinity of the outer end portion of the diaphragm 20. Description of the same parts as those in the first embodiment is partially omitted.

Figure 4:
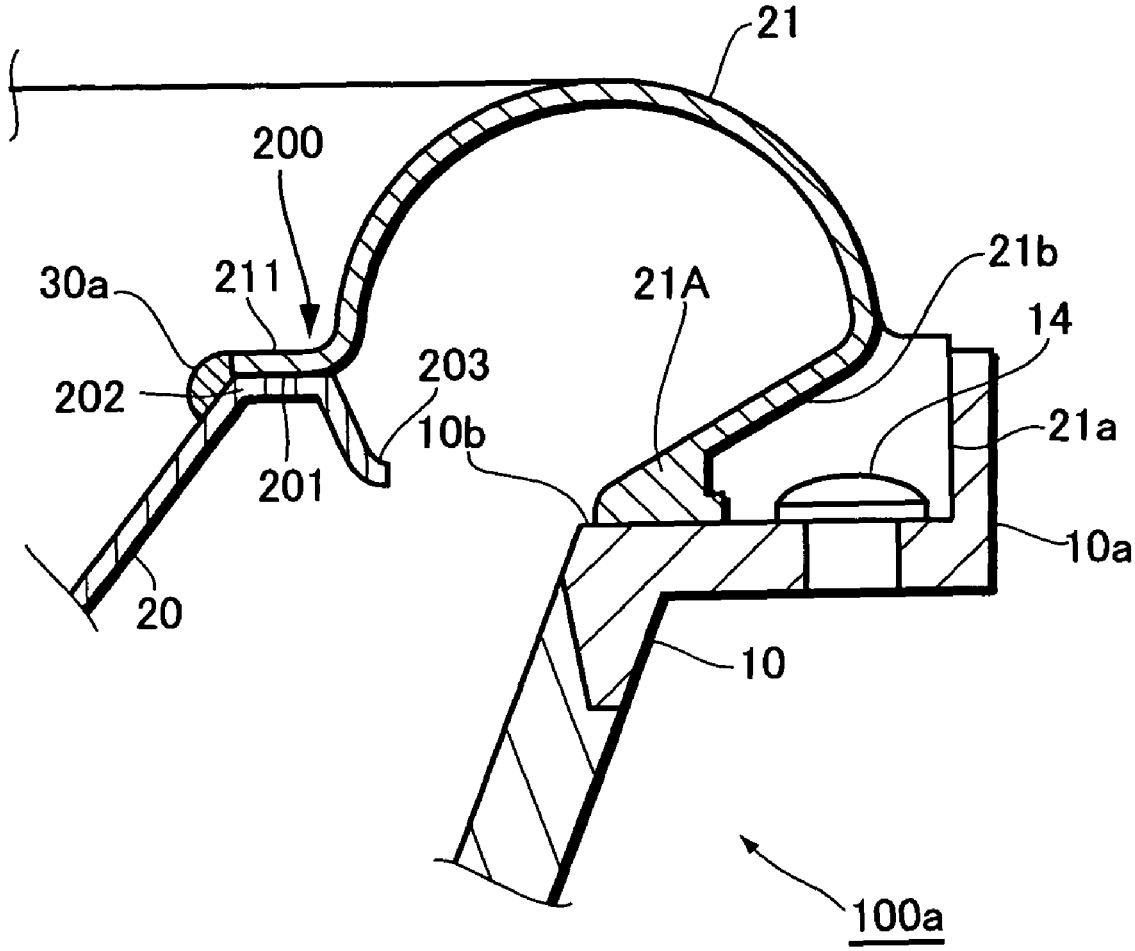
FIG. 4 is a view illustrating a loudspeaker 100*a* according to the second embodiment of the present invention, and is an enlarged view showing the vicinity of an outer end portion of the diaphragm 20.

In the loudspeaker 100*a* of the present embodiment, a reinforcing portion 30*a* is formed in a different position from that of the first embodiment. Specifically, the diaphragm 20 of this embodiment is provided with the reinforcing portion 30*a* formed on the outer side (surface side) of the bent portion 202. More specifically, as shown in FIG. 4, the reinforcing portion 30*a* provided on the surface side of the diaphragm 20 is formed on a border at the inner periphery side of the connecting portion 200 connecting the inner periphery 211 of the edge 21 with the outer periphery of the diaphragm 20.

According to the loudspeaker 100*a* of the present embodiment as described above, the reinforcing portion 30*a* is formed on the outer side (surface side) of the bent portion 202, so that the bent portion 202 of the diaphragm 20 can be easily reinforced. More specifically, the reinforcing portion 30*a* of the present embodiment is formed by coating a reinforcing agent or attaching a reinforcing member on the surface side of the diaphragm 20, so that the reinforcing portion 30*a* can be formed on the surface side of the diaphragm 20 in an easier manner than that of the first embodiment.

Third Embodiment

FIG.. 5 is a view illustrating a loudspeaker 10*b* according to the third embodiment of the present invention, and is an enlarged view showing the vicinity of the outer end portion of the diaphragm 20. Description of the same parts as those in the first and second embodiments is partially omitted.

Figure 5:
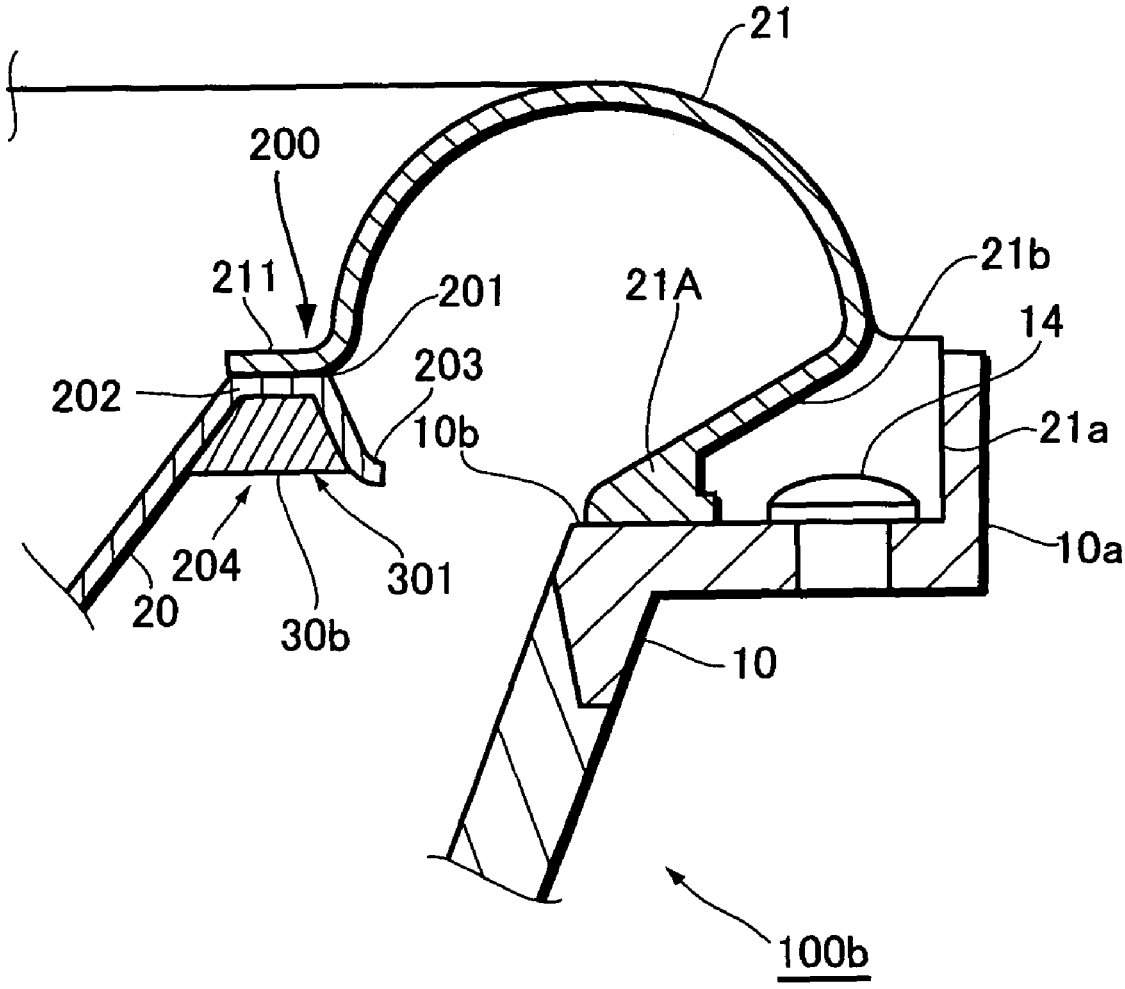
FIG. 5 is a view illustrating a loudspeaker 100*b* according to the third embodiment of the present invention, and is an enlarged view showing the vicinity of the outer end portion of the diaphragm 20.

In the loudspeaker 100*b* of the present embodiment, a reinforcing portion 30*b* is formed in a different position or formed into a different shape, compared to those of the first and second embodiments. Specifically, the reinforcing portion 30*b* of this embodiment is provided inside a recessed portion 204 that is formed by the bent portion 202 and the folding portion 203, with a predetermined thickness, as shown in FIG. 5.

In addition, the reinforcing portion 30*b* may be formed by attaching a reinforcing member 301 having high elasticity and high internal loss property, such as a resin material or a rubber, on the bent portion 202. The reinforcing portion 30*b*may also be formed by coating the reinforcing agent having high elasticity and high internal loss property on the bent portion 202.

In the loudspeaker 100*b* as configured above, the reinforcing portion 30*b* is provided inside all recessed portion 204 that is formed by the bent portion 202 and the folding portion 203, with a predetermined thickness. Therefore, various forces applied to the bent portion 202 can be dispersed or reduced by the reinforcing portion 30*b* and the folding portion 203 when sound signals having large amplitude are applied to the loudspeaker 100, so that strength deterioration or damage of the diaphragm 20 can be prevented. Thus, deterioration of acoustic characteristics also can be prevented.

Fourth Embodiment

Figure 6:
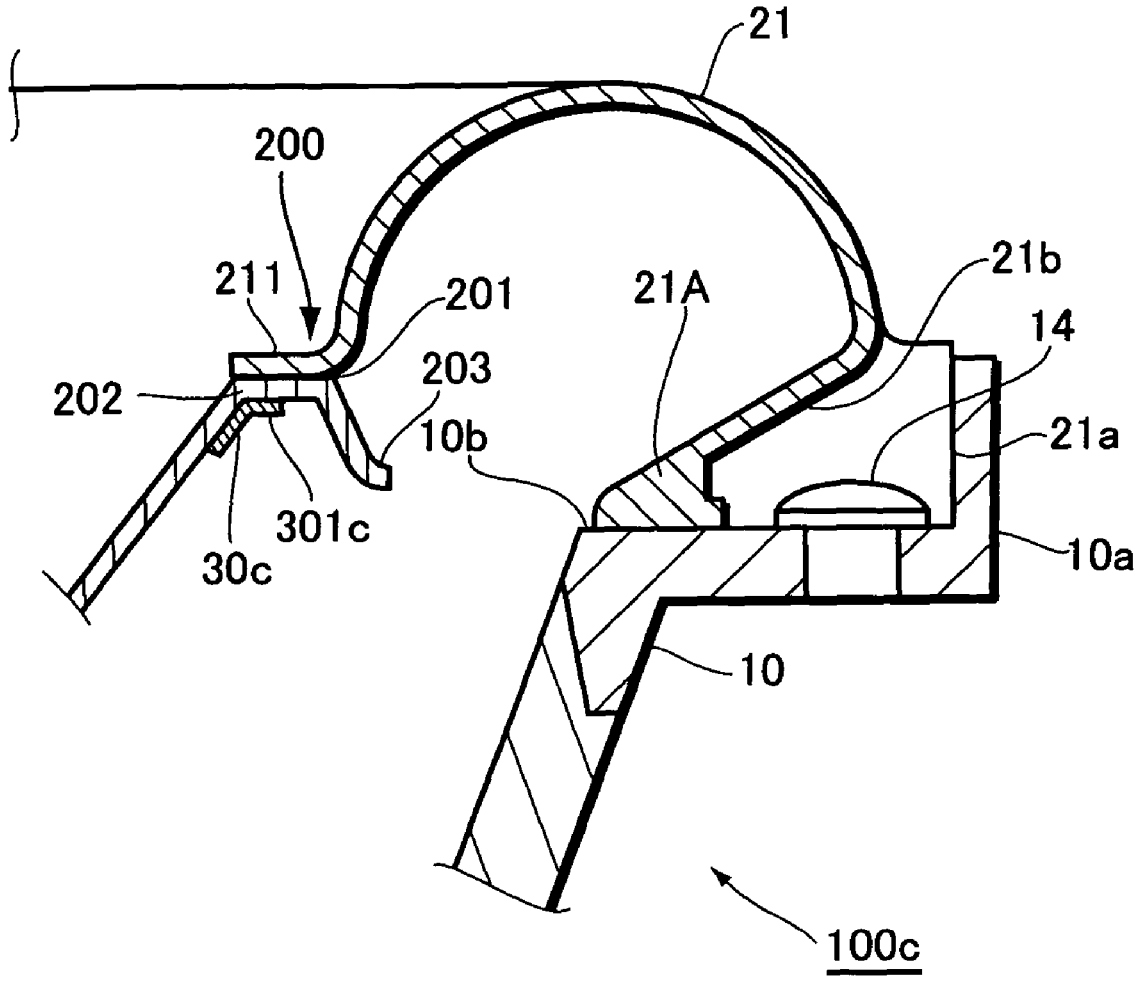
FIG. 6 is a view illustrating a loudspeaker 100*c* according to the fourth embodiment of the present invention, and is an enlarged view showing the vicinity of the outer end portion of the diaphragm 20.

FIG. 6 is a view illustrating a loudspeaker 10*c* according to the fourth embodiment of the present invention, and is an enlarged view showing the vicinity of the outer end portion of the diaphragm 20. Description of the same parts as those in the first to third embodiments is partially omitted.

In the loudspeaker 100*c* of the present embodiment, a reinforcing portion 30*c* is formed in a different forming way, compared to those of the first to third embodiments. In specific, the reinforcing portion 30*c* of the present embodiment is formed by attaching a sheet-like reinforcing member 301*c* having high elasticity and high internal loss property, such as an unwoven fabric Or a rubber, on the inner side (back side) of the bent portion 202, as shown in FIG. 6

In the loudspeaker 100*c* with the reinforcing portion 30*c* as configured above, the reinforcing portion 30*c* can be formed by an easier process, compared to those of the first to third embodiments.

Fifth Embodiment

Figure 7A:
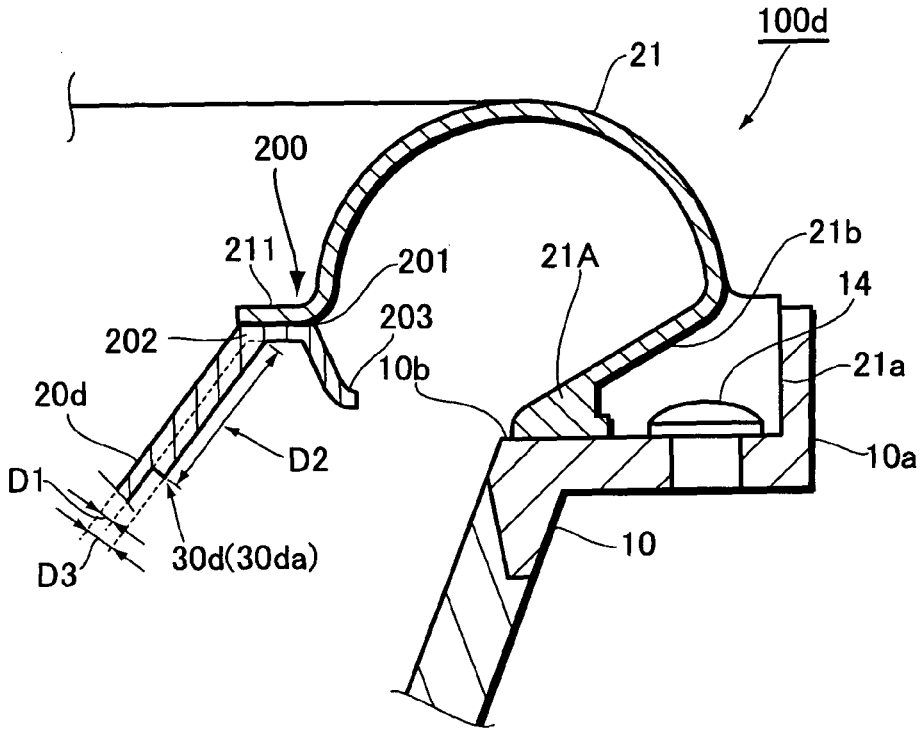
FIGS. 7A and 7B are views illustrating an loudspeaker 100*d* according to the fifth embodiment of the present invention, and are enlarged views showing the vicinity of the outer end portion of the diaphragm 20.
Figure 7B:
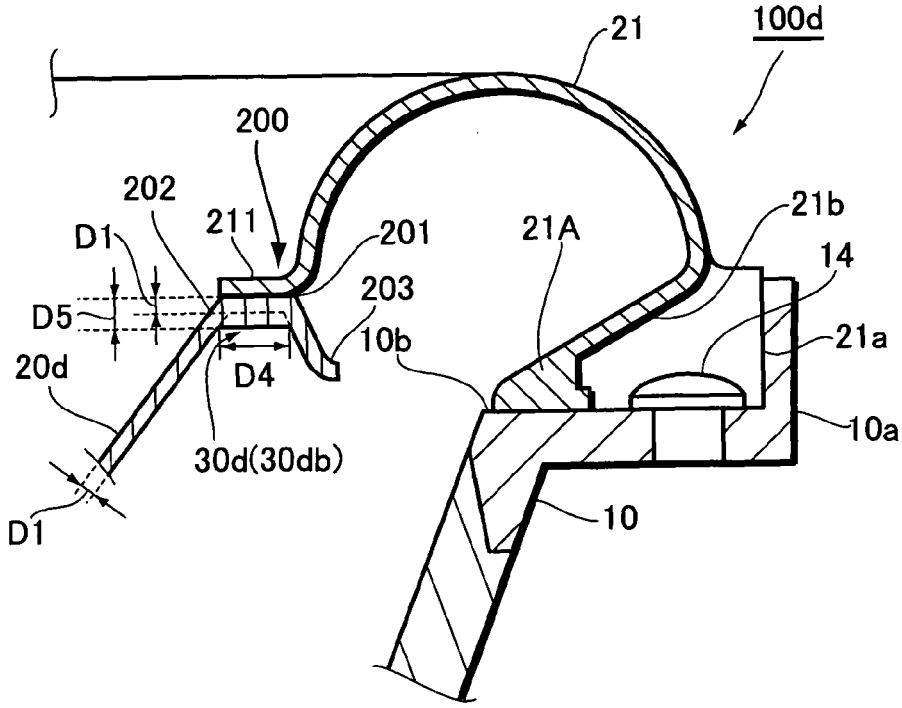

FIGS. 7A and 7B are views illustrating a loudspeaker 100*d* according to the fifth embodiment of the present invention, and is an enlarged view showing the outer end portion of a diaphragm 20*d*. Description of the same parts as those in the first to fourth embodiments is partially omitted.

As a reinforcing portion 30*d* in the loudspeaker 100*d* of the present embodiment, the thickness of the diaphragm 20*d* adjacent to the bent portion 202 is formed to be thicker than the other portions in order to reinforce the bent portion 202. Specifically, as shown in FIG. 7A, the diaphragm 20*d* has the thickness of D1 in the vicinity of the coil bobbin 6, while it has the thickness of D3 as a reinforcing portion 30*d*a within an area of a predetermined length D2 located from the bent portion 202 toward an internal circumference thereof, in which the thickness D3 is formed thicker than the thickness D1.

Moreover, the reinforcing portion 30*d* is not limited to that as mentioned above. As shown in FIG.. 7B, for example, the diaphragm 20*d* extended from the bent portion 202 toward the internal circumference has the thickness of D1, while the diaphragm 20*d* may have the thickness of D5 thicker than the thickness of D1 as a reinforcing portion 30*d*b in the area of a predetermined length D4 extended from the bent portion 202 toward an external circumference thereof. Further, the diaphragm 20*d* may be provided with both of therein forcing portions 30*da* and 30*db* as mentioned above. Moreover, the length D2, D4 and the thickness D3 and D5 may be set in accordance with, for example, a level of sound signals being input into the loudspeaker 100*d* and a strength of the bent portion 202 in the diaphragm 20*d*.

As mentioned above, the reinforcing portion 30*d* of the loudspeaker 100*d* is formed by making the thickness of the diaphragm 20*d* itself in the vicinity of the bent portion 202 be thicker than that of the other portions in the diaphragm 20*d*, so that the reinforcing portion 30*d* can disperse or reduce various forces applied to the bent portion 202 even when sound signals having large amplitude are applied, thereby preventing the strength deterioration or damage of the diaphragm 20*d*. In other words, since the diaphragm 20*d* is integrally formed having the thickness in the vicinity of the bent portion 202 which is thicker than that of the other portions, the diaphragm 20*d* provided with the reinforcing portions 30*d* of the present invention can be obtained under an easy manufacturing step.

Sixth Embodiment

Figure 8:
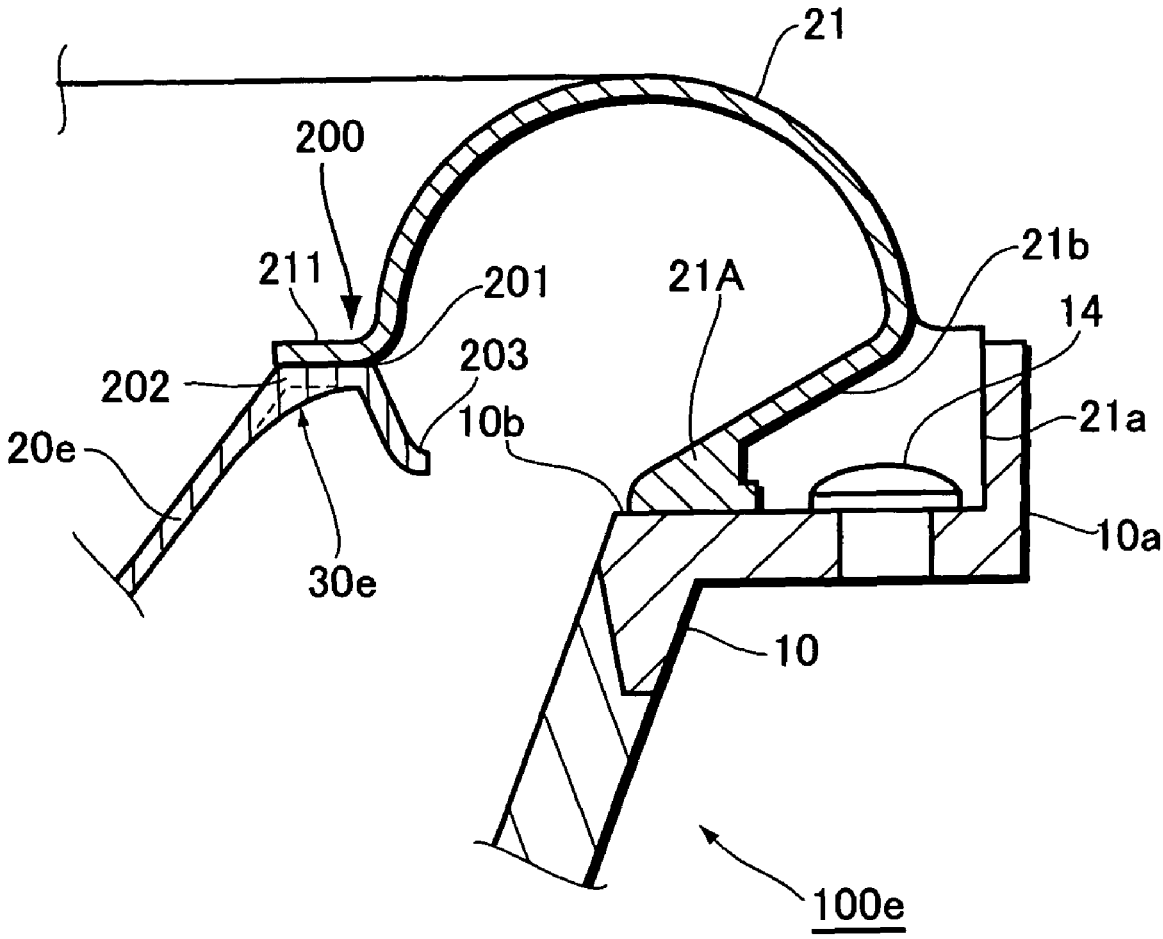
FIG. 8 is a view illustrating a loudspeaker 100*e* according to the sixth embodiment of the present invention, and is an enlarged view showing the vicinity of the outer end portion of the diaphragm 20.

FIG. 8 is a view illustrating a loudspeaker 100*e* according to the sixth embodiment of the present invention, and is an enlarged view showing the outer end portion of a diaphragm 20*e*. Description of the same parts as those in the first to fifth embodiments is partially omitted.

The loudspeaker 10*e* of the present embodiment has the diaphragm 20*e* provided with a reinforcing portion 30*e* which is formed through making the inside of the bent portion 202 into a curved shape. The reinforcing portion 30*e* may be formed integrally with the diaphragm 20*e*. A radius of curvature or the thickness in the curved shape of the reinforcing portion 30*e* is set in accordance with, for example, the level of sound signals being input into the loudspeaker 10*e* or the strength of the bent portion 202 in the diaphragm 20*e*.

As mentioned above, since the loudspeaker 10*e* has the diaphragm 20*e* provided with a reinforcing portion 30*e* which is formed through making the inside of the bent portion 202 into a curved shape, it is possible to disperse or reduce the various forces applied to the bent portion 202 with such a simple configuration. In the case that the reinforcing portion 30*e* is formed integrally with the diaphragm 20*e*, such an effective reinforcing portion 30*e* can be easily obtained.

Additionally, the reinforcing portions 30*d* and 30*e* of the fifth and sixth embodiments may be combined, thereby further preventing a deterioration of strength or damage to the bent portion 202.

Seventh Embodiment

Figure 9A:
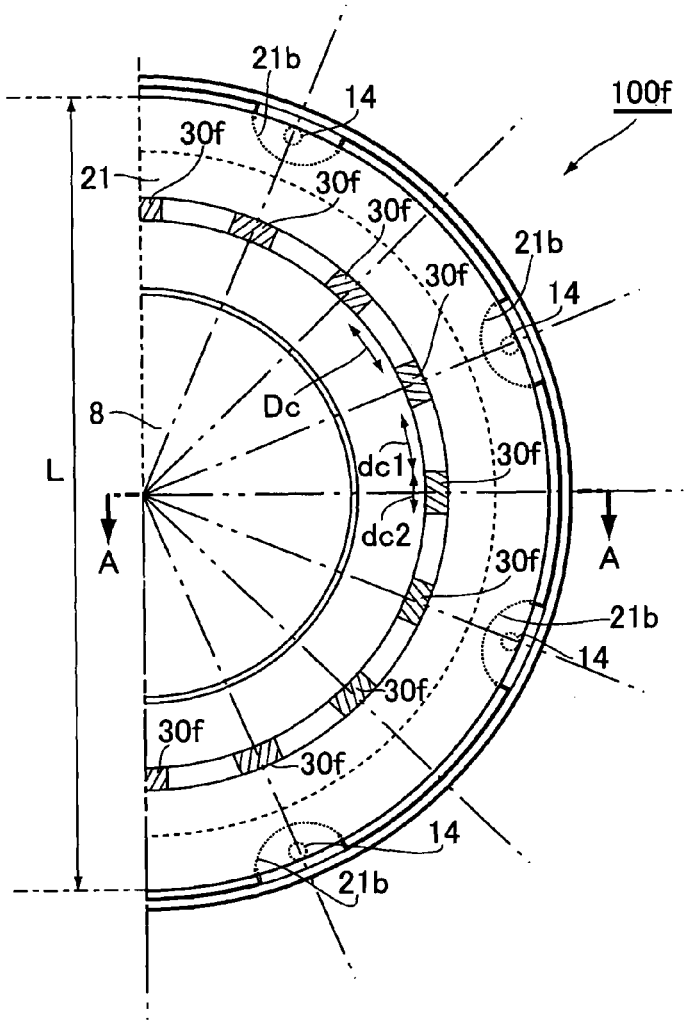
FIGS. 9A and 9B illustrate a loudspeaker 100*f* according to the seventh embodiment of the present invention.
Figure 9B:
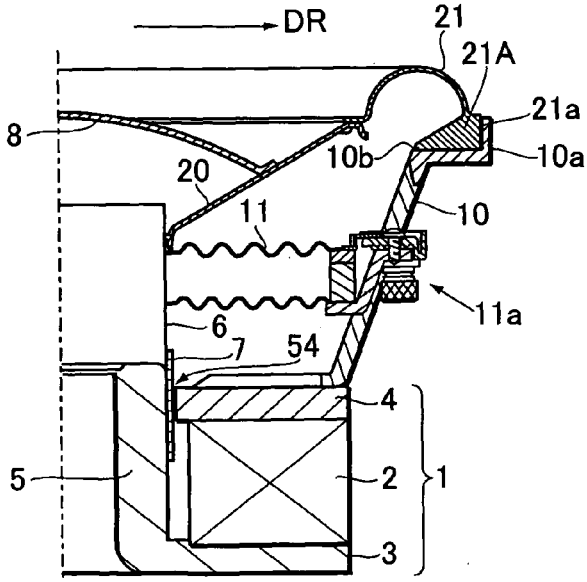

FIGS. 9A and 9B are views illustrating a loudspeaker 100*f* according to the seventh embodiment of the present invention. FIG. 9A is a plan view of the loudspeaker 10*f*, and FIG. 9B is a sectional view taken along a line A-A shown in FIG. 9A. Description of the same parts as those in the first to sixth embodiments is partially omitted.

The loudspeaker 100*f* according to the present embodiment has reinforcing portions 30*f* which are formed at predetermined regular intervals along a circumferential direction DC of the bent portion 202. Specifically, as shown in FIG. 9A, the reinforcing portions 3 of are formed with a predetermined length dc2 at the predetermined interval dc1 along the circumferential direction. The predetermined length dc2 and the predetermined interval dc1 are set in accordance with, for example, level of the sound signal inputted into the loudspeaker 100*f*, strength of the bent portion 202 in the diaphragm 20, acoustic characteristic of the loudspeaker 100*f* or manufacturing cost and time of the reinforcing portion 30*f*.

Since the loudspeaker 100*f* has the reinforcing portions 30*f* which are not continuous, but in regular intervals, material for making the reinforcing portion 30*f* can be reduced. As a result, manufacturing cost of the loudspeaker 100*f* can be lowered. In addition, a disposing position of the reinforcing portion 30*f* may be selected to obtain the desired acoustic characteristic of the loudspeaker 100*f*.

Eighth Embodiment

Figure 10:
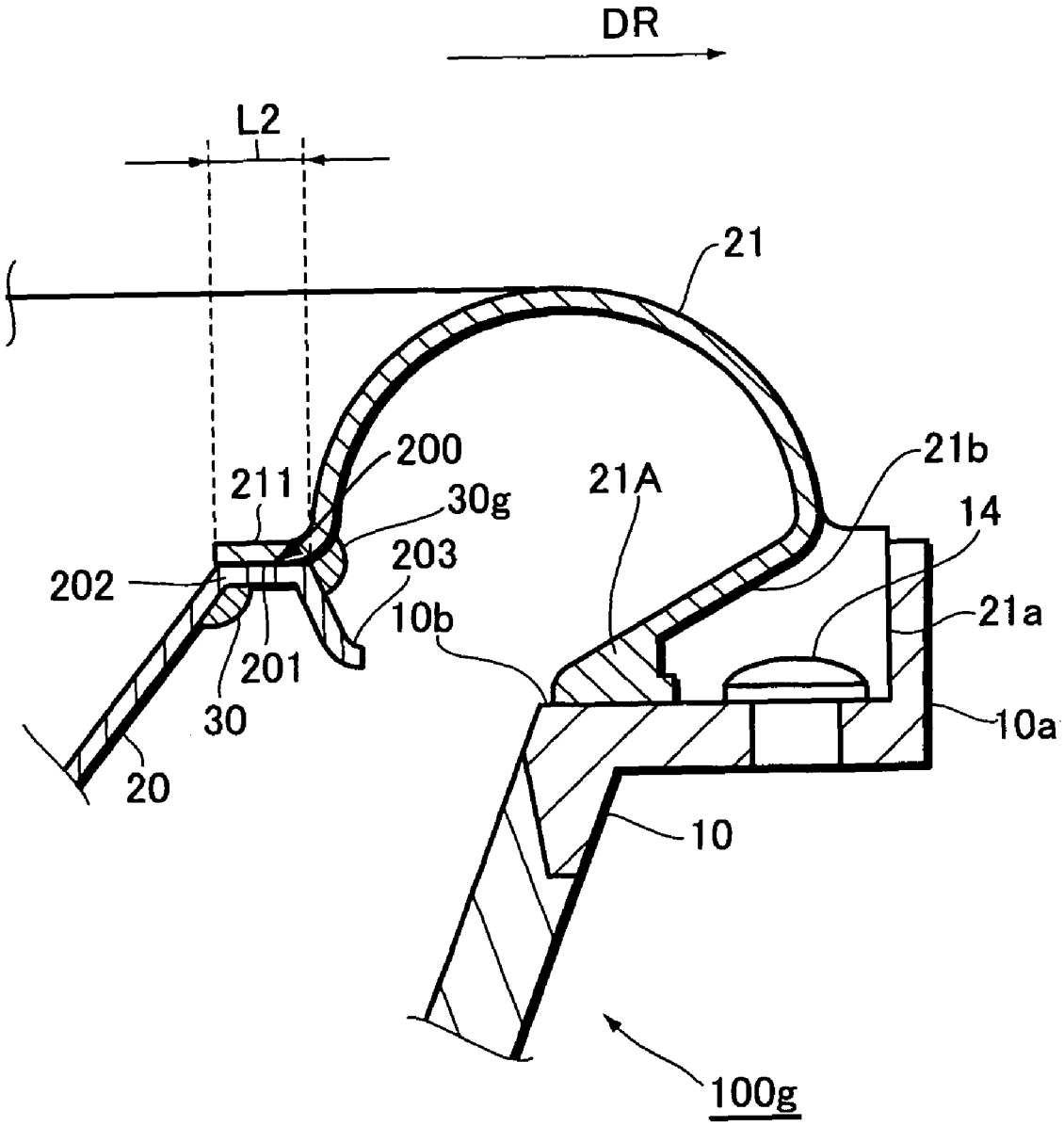
FIG. 10 is a view illustrating a loudspeaker 10*g* according to the eighth embodiment of the present invention, and is an enlarged view showing the vicinity of the outer end portion of the diaphragm 20.

FIG. 10 is a view illustrating a loudspeaker 100*g* according to the eighth embodiment of the present invention, and is an enlarged view showing the outer end portion of a diaphragm 20. Description of the same parts as those in the first embodiment is partially omitted.

The loudspeaker 100*g* further has a reinforcing portion 30*g* which is formed at the folding portion 203 provided in the vicinity of the border on the outer peripheral side of the connecting portion 200 in addition to the reinforcing portion 30 of the first embodiment specifically, the reinforcing portion 30*g* is formed in such a manner that it contacts with both of the folding portion 203 and the edge 21 as shown in FIG.. 10. In the loudspeaker 10*g*, since the reinforcing portion 30*g* is further provided at the folding portion 203, it is possible to prevent strength deterioration or damage of the folding portion 20 in addition to that of the bent portion 202.

Moreover, the present invention is not limited to the above-mentioned embodiments. Also, some of the embodiments may be combined.

Further, in the above embodiments, the present invention was explained with the up-rolled edge speaker as the free-edge speaker, but it is not limited thereto. Of course, the down-rolled edge speaker, for example, may be used. Further, the present invention may be applied to any loudspeaker provided with an edge having various kinds of shape or functions such as a flat edge, U-shaped edge, V-shaped edge, gathered edge, radial edge, or cylindrical edge.

Additionally, although the loudspeaker provided with a circular cone-type diaphragm was used for explaining the present invention in the above-mentioned description, the loudspeaker of the present invention is not limited to such a configuration. That is, the loudspeaker of the present invention may have various kinds of shape such as substantially elliptic one or flat one.

As described above, the loudspeaker 100 of this embodiment includes the diaphragm 20 and the edge 21 having the inner periphery end portion thereof connected with the outer periphery of the diaphragm 20, and the outer end portion thereof attached to the speaker frame 10. The diaphragm 20 has the bent portion 202 in the vicinity of a border on the inner periphery side of the connecting portion 200 connecting the diaphragm 20 and the edge 21. The reinforcing portion 30 is formed on the bent portion 202 in order to reinforce the bent portion 202. It is, therefore, possible to disperse or reduce various forces applied to the bent portion 202, and to prevent strength deterioration or damage of the diaphragm 20 even when sound signals having large amplitude are applied to the loudspeaker 100. As a result, it is also possible to prevent deterioration of acoustic characteristics.

While there has been described what are at present considered to be preferred embodiments of the present invention, it will be understood that various modifications may be made thereto, and it is intended that the appended claims cover all such modifications as fall within the true spirit and scope of the invention.

What is claimed is:

1. A loudspeaker comprising:

a diaphragm;

an edge connected with an outer periphery of the diaphragm; and a speaker frame, on which an outer end portion of the edge is mounted, wherein the diaphragm includes a first bent portion in a vicinity of a border at an inner periphery of a connecting portion for connecting the diaphragm with the edge, a second bent portion in a vicinity of a border at an outer periphery of the connecting portion, and a folding portion for further reinforcing the second bent portion, the folding portion being formed more toward the outer periphery of the diaphragm than the second bent portion; and wherein one of the first and second bent portions is provided with a reinforcing portion for reinforcing one of the first and second bent portions.

2. The loudspeaker according to claim 1, wherein the reinforcing portion is formed on either an inner side or an outer side of the first bent portion, or on both the inner and outer sides of the first bent portion.

3. The loudspeaker according to claim 1, wherein the diaphragm has a conical shape, and wherein the diaphragm at the first and second bent portions are bent outward with respect to a generatrix line of the diaphragm.

4. The loudspeaker according to claim 1, wherein the first bent portion of the diaphragm is formed in the vicinity of the border at the inner periphery of an attaching surface between an outer periphery portion of the diaphragm and an inner periphery portion of the edge.

5. The loudspeaker according to claim 4, wherein the connecting portion formed between the first bent portion and the second bent portion of the diaphragm is connected with the inner periphery portion of the edge of the diaphragm, and wherein the connecting portion is vertical to a vibration direction of the diaphragm.

6. The loudspeaker according to claim 1, wherein the reinforcing portion is formed inside a recessed portion that is formed by the first and second bent portions and the folding portion.

7. The loudspeaker according to claim 1, wherein the reinforcing portion is formed with a diaphragm thickness in a portion adjacent to the first bent portion being thicker than the other portions of the diaphragm.

8. The loudspeaker according to claim 1, wherein the reinforcing portion is formed by a curve-shaped portion provided inside the first bent portion in the diaphragm.

9. The loudspeaker according to claim 1, wherein the reinforcing portion is formed at a predetermined interval along a circumferential direction of the diaphragm.

10. The loudspeaker according to claim 1, wherein the reinforcing portion has one of higher elasticity than a predetermined value and higher internal loss property than a predetermined value.

11. The loudspeaker according to claim 1, wherein the reinforcing portion is formed by coating a reinforcing agent having high elasticity and high internal loss property onto one of the first and second bent portions.

12. The loudspeaker according to claim 1, wherein the reinforcing portion is formed by attaching a reinforcing member having high elasticity and high internal loss property onto one of the first and second bent portions.

13. The loudspeaker according to claim 1, wherein the reinforcing portion includes at least either material of silicone, a resin material, a rubber, and an unwoven fabric.

* * * * *